United States Patent [19]

Brown

[11] 4,223,473

[45] Sep. 23, 1980

[54] SOFT FLYING GAME DISC

[76] Inventor: James L. Brown, 18552 Mendocino Cir., Villa Park, Calif. 92667

[21] Appl. No.: 965,077

[22] Filed: Nov. 30, 1978

[51] Int. Cl.[3] ..... A63H 33/18

[52] U.S. Cl. ..... 46/74 D

[58] Field of Search ..... 46/74 D, 74 R, 75; 273/106 B; 2/171.2, 195

[56] References Cited

U.S. PATENT DOCUMENTS

| | | | |
|---|---|---|---|
| 1,144,366 | 6/1915 | Levine | 2/195 |
| 1,593,453 | 7/1925 | Hinsen | 273/106 B |
| 3,571,811 | 3/1971 | Wilson | 2/195 |
| 3,852,910 | 12/1974 | Everett | 46/74 D |
| 4,115,946 | 9/1978 | Vukmirovich | 46/74 D |

*Primary Examiner*—Jay N. Eskovitz

*Attorney, Agent, or Firm*—Louis J. Bachand

[57] ABSTRACT

A soft flying game disc comprising a limp, generally circular fabric locally annularly stiffened inwardly of the fabric peripheral edge margin in central air foil and peripheral spoiler skirt structure defining relation.

20 Claims, 6 Drawing Figures

SOFT FLYING GAME DISC

BACKGROUND OF THE INVENTION

This invention has to do with flying game discs of the type popularized by the Frisbee (trademark). More particularly the invention has to do with soft flying game discs, which are useful indoors, in congested areas such as the beach, which are harmless in striking walls, windows and people, and which are crumplable for stuffing into the pocket, or drawer storage.

Flying game discs such as the Frisbee flying disc mentioned above are widely known and popular with persons of all ages. The most popular models are rigid polyolefin plastic shells suitably shaped to provide an air foil structure. By the term "air foil structure", herein is meant a structure which presents to an airstream a differential path over the upper and lower surface periphery of the structure. Typically, an air foil surface can be seen in a wing which has a convex upper surface and a generally planar lower surface, whereby the airstream travel path over the upper surface, is longer than the path below, whereby lift is generated. In a flying disc, a slight doming of the upper surface provides this air foil effect.

In rigid flying discs, a downwardly curled periphery presents a toroidal leading edge which contributes to the gyroscopic effect in such devices, which lends stability to flight as the device spins through the air.

PRIOR ART

While not nearly so well-known or popular, it has been proposed to provide a non-rigid flying disc. Thus, in recently issued U.S. Pat. No. 4,115,946, to Vukmirovich, a cloth "beanie" is weighted at its perimeter with discrete weights which are alleged to fly out centrifugally upon hurling the beanie, whereby a flying disc effect is realized. The deficiencies of the Vukmirovich beanie include the tendency of the outwardly thrown perimeter weights to flatten the beanie body lessening the air foil effect by reducing the doming of the central portion of the disc. Also, the suggested perimeter weighting may impart undue levels of momentum to the device whereby the desired goals of safety indoors and against glass and persons may be forfeited. Compare, for example, the spectacular top hat wore by Oddjob in the James Bond thriller "Goldfinger" which was apparently a conventional hat with a steel brim, which could be hurled with great force against objects, for the purpose of destroying them.

More sophisticated concepts of flying game discs are found, for example, in U.S. Pat. No. 3,852,910 to Everett, wherein the role of spoilers in flying disc design is discussed. As is known from aircraft technology, and set forth to some extent in the Everett patent mentioned, spoilers are discontinuities on the air foil surface which have the apparent effect of lengthening the air flow path artificially, increasing thereby the lift imparted as the air flows over the now discontinuous air foil.

SUMMARY OF THE INVENTION

It is accordingly an object of the present invention to provide a flying game disc, which is simple in design, soft flying, harmless to persons, glass and the like and readily transported in pocket or purse. It is a further object to provide such a device which has enhanced lift and flight stability characteristics through the provision of an airstream responsive air foil and a cooperating spoiler structure.

These and other objects of the invention to become apparent hereinafter, are realized in a flying game disc having air foil path determined lift and flight stability characteristics, the disc comprising a limp generally circular fabric stiffened along an annular locus extending inward of the fabric peripheral edge margin in central air foil structure-, and peripheral spoiler skirt structure-defining relation whereby the air flow path is increased and lift and flight stability characteristics of the disc enhanced.

In particular embodiments: the fabric comprises one or multiple layers of cloth; there is provided means forming a torus tangential to the stiffening locus and normally depending from the disc; the fabric is baggy within the stiffening locus to airstream responsively billow into air foil shaped structure during disc flight; the fabric peripheral edge margin is radially dimensioned to be free edge self-supporting outward beyond the stiffening locus, and the air foil structure and the spoiler skirt structure are both formed of at least one unitary piece of fabric.

In a highly preferred embodiment of the invention, there is provided a soft flying game disc having air flow path determined lift and flight stability characteristics, the disc comprising a limp, generally circular fabric member having a first diameter, a relatively stiffer, separately formed annular element having a second, lesser diameter coaxial with and secured to the fabric member to delimit and differentially support central and perimetrical fabric member portions of relative size determined by the first and second diameters, the central portion being relatively less supported and more airstream displacement responsive during disc flight in air foil structure-defining relation; the perimetrical portion being relatively more supported and less airstream displacement responsive in spoiler skirt structure-defining relation relative to the air foil, whereby the disc diametrical dimension is effectively increased beyond the annular element diameter, increasing correspondingly the peripheral air flow path over the disc, the flow path determined lift and flight stability characteristics being thus enhanced. In this embodiment, the annular element may be circumferentially continuous, dimensionally resilient and toroidal in configuration. The fabric member may be perimetrically crenulate, comprise multiple layers of cloth and have central and perimetrical fabric member portions both formed of at least one unitary piece of cloth.

There is further provided in accordance with the invention in these embodiments an additional fabric layer connected to the perimetrical fabric member portion beyond the annular member in stiffening relation. Thus, there may be provided a soft flying disc in which the annular element is a dimensionally resilient, circumferentially integral torus, the additional fabric layer enclosing the element in securing relation to the fabric member; stitching on the perimetrical fabric portion being arranged to effect the crenulate perimeter thereon, the annular element comprising compressed and peripherially confined packing, the packing typically being longitudinal wadded and crinkled paper, suitably confined by a thin plastic casing.

In a specific form of the invention, there is provided a soft flying game disc having air flow path determined lift and flight stability characteristics, the disc including a fabric member comprising multiple layers of generally circular limp cloth pieces having a common first diameter, a relatively stiffer, separately formed, dimensionally resilient and circumferentially integral toroidal element wrapped in a further cloth piece, and having a second, lesser diameter, the element being coaxially secured to the fabric member by sewing its cloth wrapper peripherially to the circular cloth pieces to delimit and differentially support a fabric member central portion sized to be relatively less supported and baggy inward of the element and a fabric member perimetrical portion outward of the element sized to be relatively more supported and stiffer, and further stiffened by the element cloth wrapper being sewn thereto; the central portion having relatively greater airstream displacement response during disc flight in air foil structure-defining relation; the perimetrical portion having relatively less airstream displacement response during disc flight in spoiler skirt structure defining relation, whereby the disc diametrical dimension is effectively increased beyond the toroidal element diameter, increasing correspondingly the peripheral air flow path over the disc, the flow path determined lift and flight stability characteristic being thus enhanced.

It will be observed in the ensuing description that the several components of the disc are sewn together in a single step, a significant manufacturing economy.

BRIEF DESCRIPTION OF THE DRAWINGS

The invention will be further described as to an illustrative embodiment in conjunction with the attached drawing, in which.

DESCRIPTION OF THE PREFERRED EMBODIMENTS

Figure 2:
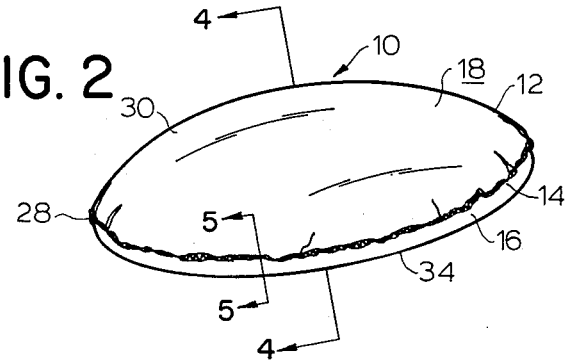
FIG. 2 is a perspective view of the same flying game disc in its flight mode.
Figure 4:
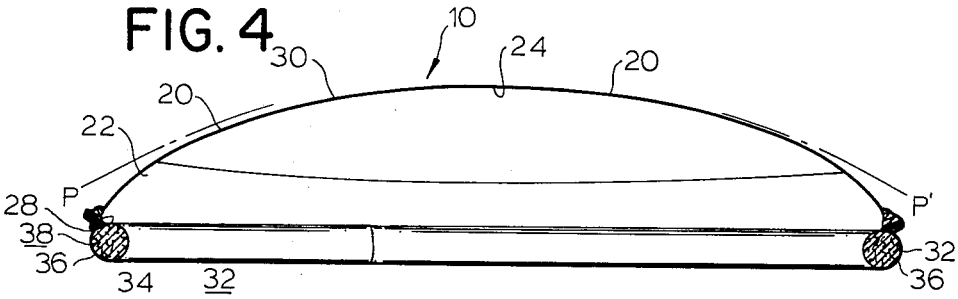
FIG. 4 is a view in vertical section taken on line 4—4 in FIG. 2.

With reference now to the drawings in detail, the soft flying game disc 10 is adapted to be tossed or hurled through the air with a spinning motion, and when so launched it billows into an air foil shaped structure indicated at 12, and more particularly shown in FIGS. 2 and 4. Simultaneously, peripheral spoiler skirt structure S, more particularly identified by numeral 14 projects edge freely beyond the disc proper, i.e, beyond the leading toroidal edge 16, and sets up disburbed air currents irregularly about the periphery of the disc, "spoiling" the air flow over the air foil structure 12 effectively lengthening the nominal air flow path, e.g. P to P' over the air foil and thus enhancing lift.

Figure 1:
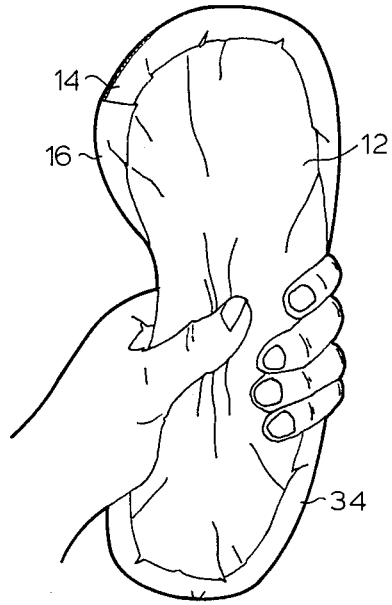
FIG. 1 is a perspective view of the flying game disc according to the invention, crumpled and flaccid, prior to flight use.

With particular reference to FIGS. 1, 2 and 4, now, the present soft game flying disc comprises a limp generally circular fabric member 18, typically formed and here shown as two cloth layers 20, 22, the lower of which has a soft film 24 laminated thereto to lightly rigidify the fabric member 18 central portion 30. The particular cloth employed is not critical, provided it has soft "hand", i.e. drapes readily and is not boardy or harsh feeling. The term "fabric", herein includes sheet materials of natural or synthetic fiber, woven or nonwoven, and synthetic compounds calendered or otherwise formed into sheets between, e.g. 3 and 25 mils in thickness. The essential characteristic of such fabric is limpness to the extent that the fabric will be crumplable, i.e. conform readily to compression forces or drape over an object on which it is placed, and will not readily set or become permanently creased.

The fabric member 18 is preferably formed of two or more layers 20, 22 of cloth as shown, by cutting the cloth 20, 22, into circles of appropriate diameter, e.g. 5 to 12 inches. These fabric circles are then fastened together perimetrically at 26 and locally annularly stiffened at 28 as described hereinbelow.

It is a signal feature of the invention that the fabric circles 20, 22 are locally stiffened in a manner, such that the circles are baggy inward of the stiffened zone, i.e. baggy at 30, for air foil structure forming purposes as will be explained hereinafter.

Figure 3:
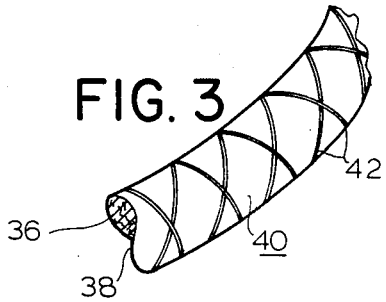
FIG. 3 is a fragmentary section of an annular support member.
Figure 5:
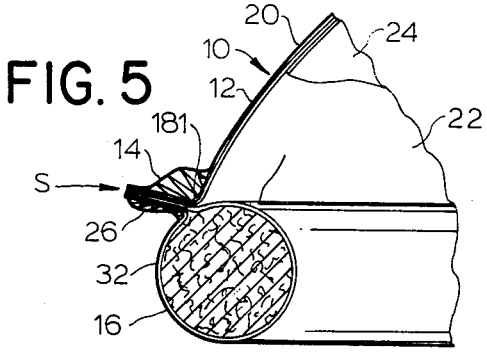
FIG. 5 is a detail fragmentary view of the peripheral edge margin and support member assembly according to the invention.

Turning now to the mode of annularly stiffening the fabric member 18 for flight, and for purposes of adding sufficient mass to allow momentum development when hurling the disc 10, there is provided additional fabric 32 at the periphery of the fabric member. In a preferred embodiment, this is accomplished by fabricating annular element 34 to be toroidal in configuration (See FIG. 4) by enveloping a preformed torus 36, a section of which is shown in FIG. 3, of longitudinally wadded and crinkled paper 38 peripherally confined within a thin plastic film casing 40, and cross-banded with reinforcing thread 42, with further fabric 32 which may be of like cloth to the circles of cloth 20, 22, but bias cut. The several layers of fabric/cloth 20, 22 and 32 are then zig-zag stitched together as detailed in FIGS. 5 and 6 in one step.

A further signal feature of the invention is the specific location of the stiffening locus 28 defined by the tangential contact of the annular element 34 with the fabric member 18, i.e. inward of the fabric member perimeter, on the fabric peripheral edge margin 181, a distance determined by the relative diameters of the element 34 and fabric member 18. It will be noted that the annular element 34, toroidal in the Figures is secured inboard of the outermost portions of the fabric member 18 by virtue of the fabric 32 connection of the element to the peripheral edge margin 181 of the fabric member. This location of the toroidal element 34 divides the fabric member 18 into two portions, namely the central portion 30, previously referred to within the annular locus of stiffening 28, and a perimetrical portion coincident with the peripheral edge margin 181 of the fabric member, whereby the edge margin, being fastened along only its inner edge, has its outer edge freely projecting beyond the toroidal element 34.

Because of is relatively greater extent (some 90% of the fabric 18 diameter is within the annular locus of stiffening 28) the central portion 30 is less fully supported and tends to bagginess or sagging, while the peripheral edge margin portion 181 (less than about 10% of the fabric member diameter) is thus relatively more supported since its extent is closer to the supporting toroidal element 34. The result of this division of the fabric member 18 by the toroidal element 34 is that the central and perimetrical portions 30, 181 respectively are differentially supported and thus relatively differently responsive to airstreams encountered in disc 10 flight.

Figure 6:
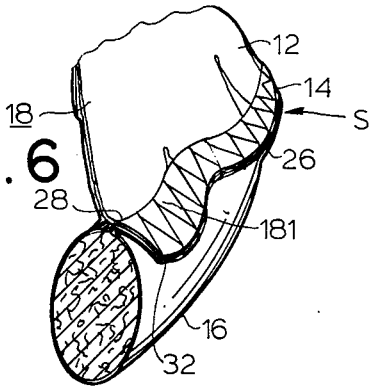
FIG. 6 is a fragmentary perspective view of the disc showing the spoiler skirt structure.

A more particular structural effect of the just described disc design is a creation of a spoiler skirt structure S, now to be described in conjunction particularly with FIG. 6.

It will be recalled that flying discs are spun through the air and when properly thrown, tend to sail. In the present flying disc 10, lift is provided by the air foil structure defined by the air stream billowing response of the fabric member central portion 30, which rises from its flaccid posture (See FIG. 1) at rest to become a dome anchored at the annular locus 28 (See FIG. 2). In accordance with known aeronautical principles, a spoiler will enhance lift, if properly placed relative to the air foil.

The skirt structure S comprising three to four layers of fabric, e.g. 20, 22, and 32, such as cloth, stitched together and closely supported along one edge is sufficiently stiff to be less responsive to passing airstreams than the fabric member central portion 30. Eddies and diverse turbulent air currents are generated around the locus of the skirt structure S as the disc 10 advances through the air, effectively lengthening the air flow path over the disc and improving lift. The skirt structure S thus cooperates with the central portion 30 air foil structure by controlledly disturbing the airstream which is about to impinge on the central portion 30 defined air foil structure.

The just described soft flying game disc thus provides the entertainment value of the rigid, old style disc, of sailing flight while being useable indoors, around fragile objects and people without fear of harm. Further, the disclosed structure including a fixed annular stiffening locus, e.g. as defined by the toroidal element 34, enables soft flight and landings without sacrificing the domed configuration of the air foil structure which is so desirable in flying game disc devices. Since the mass defined, for example, by the toroidal element 34 does not rely on discrete circumferentially separable weights or other ineffective expedients, the central portion 30 of the fabric member 18 retains its dome-like air foil structure configuration throughout flight, unflattened by centrifugal forces, but indeed confined in a doming posture by the annular stiffening locus, an effect enhanced by the circular stitching together of the assembly which tends to decrease the diameter. Moreover, the perimetrical fringe which constitutes the spoiler skirt structure cooperates with the flight created air foil structure to provide an effectively increased air flow path and increased lift. The crenulate configuration of this fringe produces interesting flight effects as the spoiler is specifically irregular around the perimeter of the disc, but grossly regular in its positioning slightly above the median line of the disc 10, owing in part to a bias cut of the additional fabric 32 securing the element 34 circularly about the fabric member 18. The disc 10 tends to have a broad tolerance for various degrees of expertise in launching with even a one finger or child's toss being effective.

For flight purposes, the disc 10 can be flown right side up as shown in the drawing; or for a less lofty and sailing flight hurled edgewise while upside down; or for a third mode of flight turned inside out and hurled edgewise, this last mode being especially useful in outdoor, cross-draft situations.

I claim:

1. A soft flying game disc having air flow path determined lift and flight stability characteristics, said disc comprising a limp, generally circular fabric, and means defining a stiffened annular locus extending circularly and inward of the fabric peripheral edge margin to form a central air foil structure circumscribed by said means and peripheral spoiler skirt structure radially beyond said means, whereby said air flow path is increased and lift and flight stability characteristics of the disc correspondingly enhanced.

2. The soft flying game disc according to claim 1, in which said fabric comprises multiple layers of cloth.

3. The soft flying game disc according to claim 1, in which said stiffening means comprises a torus at said stiffening locus and normally depending from said disc.

4. The soft flying game disc according to claim 1, in which said fabric is baggy within said stiffening locus to airstream responsively billow into air foil shaped structure during disc flight.

5. The soft flying disc according to claim 1, in which said fabric peripheral edge margin is radially dimensioned to be free edge self-supporting outward beyond said stiffening means.

6. The soft flying game disc according to claim 1, in which said air foil structure and said spoiler skirt structure are both formed of at least one unitary piece of fabric.

7. A soft flying game disc having air flow path determined lift and flight stability characteristics, said disc comprising a limp, generally circular fabric member having a first diameter, a relatively stiffer, separately formed, annular element having a second, lesser diameter, coaxial with and secured to said fabric member to delimit and differentially support central and perimetrical fabric member portions of relative size determined by said first and second diameters, said central portion being relatively less supported and more airstream displacement responsive during disc flight in air foil-structure defining relation; said perimetrical portion being relatively more supported and less airstream displacement responsive in spoiler skirt structure defining relation relative to said air foil; whereby the disc diametrical dimension is effectively increased beyond the annular element diameter, increasing correspondingly the peripheral air flow path over said disc, the flow path determined lift and flight stability characteristics being thus enhanced.

8. The soft flying game disc according to claim 7, in which said annular element is circumferentially continuous.

9. The soft flying game disc according to claim 8, in which said annular element is dimensionally resilient.

10. The soft flying game disc according to claim 9, in which said annular element is toroidal in configuration.

11. The soft flying game disc according to claim 10, in which said fabric member is perimetrically crenulate.

12. The soft flying game disc according to claim 7, in which said fabric member comprises multiple layers of cloth.

13. The soft flying game disc according to claim 7, in which said central and perimetrical fabric member portions are both formed of at least one unitary piece of cloth.

14. The soft flying game disc according to claim 13, including also an additional fabric layer connected to said perimetrical fabric member portion beyond said annular member in stiffening relation.

15. The soft flying game disc according to claim 14, in which said annular element is a dimensionally resilient, circumferentially integral torus, said additional fabric layer enclosing said element in securing relation to said fabric member.

16. The soft flying game disc according to claim 15, including also stitching on said perimetrical fabric portion arranged to effect said crenulate perimeter thereon.

17. The soft flying game disc according to claim 16, in which said element comprises compressed and peripherially confined packing.

18. The soft flying game disc according to claim 17, in which said packing is longitudinally wadded and crinkled paper.

19. A soft flying game disc according to claim 18, in which said packing is confined in a thin plastic film casing.

20. A soft flying game disc having air flow path determined lift and flight stability characteristics, said disc including a fabric member comprising multiple layers of generally circular, limp cloth pieces having a common first diameter, a relatively stiffer, separately formed, dimensionally resilient and circumferentially integral toroidal element wrapped in a further cloth piece, and said element having a second, lesser diameter, said element being coaxially secured to said fabric member by sewing its cloth wrapper peripherially to said circular cloth pieces, to delimit and differentially support a fabric member central portion sized to be relatively less supported and baggy inward of said element and a fabric member perimetrical portion outward of said element sized to be relatively more supported and stiffer and further stiffened by said element cloth wrapper being sewn thereto; said central portion having relatively greater airstream displacement response during disc flight in air foil structure defining relation; said perimetrical portion having relatively lesser airstream displacement response during disc flight in spoiler skirt structure defining relation, whereby the disc diametrical dimension is effectively increased beyond the toroidal element diameter, increasing correspondingly the peripheral air flow path over said disc, the flow path determined lift and flight stability characteristics being thus enhanced.

* * * * *